US008141758B2

(12) United States Patent
Spielberger

(10) Patent No.: US 8,141,758 B2
(45) Date of Patent: Mar. 27, 2012

(54) HOLSTER FOR SMALL ARMS

(76) Inventor: Peter Spielberger, Vienna (AT)

( * ) Notice: Subject to any disclaimer, the term of this patent is extended or adjusted under 35 U.S.C. 154(b) by 848 days.

(21) Appl. No.: 11/919,966

(22) PCT Filed: May 15, 2006

(86) PCT No.: PCT/AT2006/000200

§ 371 (c)(1),
(2), (4) Date: Nov. 6, 2007

(87) PCT Pub. No.: WO2006/119530

PCT Pub. Date: Nov. 16, 2006

(65) Prior Publication Data

US 2009/0014484 A1 Jan. 15, 2009

(30) Foreign Application Priority Data

May 13, 2005 (AT) ..... A 820/2005

(51) Int. Cl.
*F41C 33/02* (2006.01)

(52) U.S. Cl. ..... 224/243; 224/238

(58) Field of Classification Search ..... 224/192, 224/198, 238, 243, 244, 911, 912; *F41C 33/02*
See application file for complete search history.

(56) References Cited

U.S. PATENT DOCUMENTS 1,113,530 A 10/1914 Audley
1,173,376 A 2/1916 Noye
2,551,913 A 11/1948 Toby
3,530,451 A 9/1970 Devine
3,550,822 A * 12/1970 Lloyd ..... 224/193
(Continued)

FOREIGN PATENT DOCUMENTS

DE 32 22 112 A1 3/1984
(Continued)

OTHER PUBLICATIONS

Chappell Brown, "Self-contained fingerprint IDs forgo PCs, networks," EETimes, Dec. 14, 1998, Issue: 1039, Section: Technology, 3 pages.

*Primary Examiner* — Justin Larson
(74) *Attorney, Agent, or Firm* — Bennet K. Langlotz; Langlotz Patent & Trademark Works, Inc.

(57) ABSTRACT

A holster for retaining a pistol has a frame configured to receive a pistol, with a first pistol retention facility on the frame. The first pistol retention facility has a secure condition and a release condition, and operates operable to prevent extraction of a pistol from the holster when in the secure condition, and to enable extraction of the pistol when in the release condition. The first pistol retention facility includes a first actuator operable in response to deliberate user force to set the first pistol retention facility in the release condition. The holster has a second pistol retention facility on the frame, and having a secure condition and a release condition, and operable to prevent extraction of a pistol from the holster when in the secure condition, and to enable extraction of the pistol when in the release condition. The second pistol retention facility includes a second actuator operable in response to deliberate user force to set the second pistol retention facility in the release condition. The actuators may be adjacent to each other to enable simultaneous actuation, and operation of one actuator may operate the other.

18 Claims, 5 Drawing Sheets

U.S. PATENT DOCUMENTS

| | | | | |
|---|---|---|---|---|
| 3,558,090 | A | 1/1971 | Bird | |
| 4,067,132 | A | 1/1978 | Smith | |
| 4,256,243 | A | 3/1981 | Bianchi et al. | |
| 4,277,007 | A | 7/1981 | Bianchi et al. | |
| 4,354,189 | A | 10/1982 | Lemelson | |
| 4,467,545 | A | 8/1984 | Shaw, Jr. | |
| 4,488,370 | A | 12/1984 | Lemelson | |
| 4,493,433 | A | 1/1985 | Sideri et al. | |
| 4,665,397 | A | 5/1987 | Pinnow | |
| 4,694,980 | A | 9/1987 | Rogers | |
| 4,722,435 | A | 2/1988 | Mareels et al. | |
| 4,747,280 | A | 5/1988 | Shaw | |
| 4,768,021 | A | 8/1988 | Ferraro | |
| 4,788,838 | A | 12/1988 | Cislo | |
| 4,846,384 | A | 7/1989 | Perry | |
| 4,858,799 | A | 8/1989 | Young | |
| 4,858,800 | A | 8/1989 | Holtzclaw, Jr. et al. | |
| 4,890,466 | A | 1/1990 | Cislo | |
| 4,912,867 | A | 4/1990 | Dukes, Jr. | |
| 4,925,075 | A | 5/1990 | Rogers | |
| 4,944,021 | A | 7/1990 | Hoshino et al. | |
| 4,995,086 | A | 2/1991 | Lilley et al. | |
| 5,018,654 | A | 5/1991 | Rogers et al. | |
| 5,022,175 | A | 6/1991 | Oncke et al. | |
| 5,062,232 | A | 11/1991 | Eppler | |
| 5,094,376 | A | 3/1992 | Baruch | |
| 5,108,019 | A | 4/1992 | Woodward et al. | |
| 5,111,755 | A | 5/1992 | Rouse | |
| 5,118,175 | A | 6/1992 | Costello | |
| 5,161,396 | A | 11/1992 | Loeff | |
| 5,168,994 | A | 12/1992 | Beletsky et al. | |
| 5,172,575 | A | 12/1992 | Fisher | |
| 5,189,894 | A | 3/1993 | Buck | |
| 5,236,086 | A | 8/1993 | MacTaggart | |
| 5,245,329 | A | 9/1993 | Gokcebay | |
| 5,275,317 | A | 1/1994 | Rogers et al. | |
| 5,284,281 | A | 2/1994 | Nichols | |
| 5,291,766 | A | 3/1994 | Eisermann | |
| 5,337,043 | A | 8/1994 | Gokcebay | |
| 5,416,472 | A | 5/1995 | Torii, Jr. | |
| 5,419,474 | A | 5/1995 | Marx et al. | |
| 5,449,103 | A | 9/1995 | Tilley | |
| 5,461,812 | A | 10/1995 | Bennett | |
| 5,501,381 | A * | 3/1996 | Rogers et al. | 224/243 |
| 5,502,915 | A | 4/1996 | Mendelsohn et al. | |
| 5,503,157 | A | 4/1996 | Sramek | |
| 5,513,785 | A | 5/1996 | Campagna, Jr. | |
| 5,518,155 | A | 5/1996 | Gallagher | |
| 5,525,966 | A | 6/1996 | Parish | |
| 5,579,909 | A | 12/1996 | Deal | |
| 5,598,151 | A | 1/1997 | Torii, Jr. | |
| 5,603,179 | A | 2/1997 | Adams | |
| 5,611,471 | A | 3/1997 | French | |
| 5,662,219 | A | 9/1997 | Tschudy et al. | |
| 5,701,770 | A | 12/1997 | Cook et al. | |
| 5,701,828 | A | 12/1997 | Benore et al. | |
| 5,705,991 | A | 1/1998 | Kniffin et al. | |
| 5,719,950 | A | 2/1998 | Osten et al. | |
| 5,774,365 | A | 6/1998 | Ladue et al. | |
| 5,779,114 | A | 7/1998 | Owens | |
| 5,812,252 | A | 9/1998 | Bowker et al. | |
| 5,828,301 | A | 10/1998 | Sanchez | |
| 5,855,305 | A | 1/1999 | Nichols | |
| 5,855,307 | A | 1/1999 | Biddick et al. | |
| 5,875,944 | A | 3/1999 | Beletsky | |
| 5,881,933 | A | 3/1999 | Rogers | |
| 5,896,691 | A | 4/1999 | Kaminski et al. | |
| 5,905,446 | A | 5/1999 | Benore et al. | |
| 5,907,286 | A | 5/1999 | Kuma | |
| D410,773 | S | 6/1999 | Case | |
| 5,907,920 | A | 6/1999 | Laney | |
| 5,909,834 | A | 6/1999 | Parrott, III | |
| 5,910,002 | A | 6/1999 | Hunter | |
| 5,913,557 | A | 6/1999 | Jarock | |
| 5,915,936 | A | 6/1999 | Brentzel | |
| 5,916,087 | A | 6/1999 | Owens | |
| 5,918,784 | A | 7/1999 | Serpa | |
| 5,918,786 | A | 7/1999 | Wise | |
| 5,927,578 | A | 7/1999 | Kay | |
| 5,931,358 | A | 8/1999 | Rogers | |
| 5,933,515 | A | 8/1999 | Pu et al. | |
| 5,936,544 | A | 8/1999 | Gonzales et al. | |
| 5,937,557 | A | 8/1999 | Bowker et al. | |
| 5,944,239 | A | 8/1999 | Rogers et al. | |
| 5,953,844 | A | 9/1999 | Harling et al. | |
| 5,957,357 | A | 9/1999 | Kallman | |
| 5,961,013 | A | 10/1999 | Collins | |
| 5,967,391 | A | 10/1999 | Hunt | |
| 5,971,239 | A | 10/1999 | Marable | |
| 5,971,240 | A | 10/1999 | Dequaine | |
| 5,987,796 | A | 11/1999 | Brooks | |
| 5,987,941 | A | 11/1999 | Zocco | |
| 5,988,467 | A | 11/1999 | Brustein | |
| 6,230,946 | B1 | 5/2001 | Vor Keller et al. | |
| 6,267,279 | B1 | 7/2001 | Matthews | |
| 6,320,975 | B1 | 11/2001 | Vieweg | |
| 6,371,341 | B1 * | 4/2002 | Clifton, Jr. | 224/243 |
| 6,769,581 | B2 * | 8/2004 | Rogers et al. | 224/243 |
| 7,461,765 | B2 * | 12/2008 | French et al. | 224/243 |
| 7,556,181 | B2 * | 7/2009 | Spielberger | 224/244 |
| 2001/0019071 | A1 | 9/2001 | Vor Keller et al. | |
| 2001/0048009 | A1 | 12/2001 | Vor Keller et al. | |
| 2004/0050887 | A1 | 3/2004 | Spielberger | |
| 2006/0175366 | A1 * | 8/2006 | Dekaise | 224/243 |
| 2007/0181619 | A1 * | 8/2007 | Seyfert et al. | 224/196 |

FOREIGN PATENT DOCUMENTS

| | | |
|---|---|---|
| EP | 1510773 | 3/2005 |
| JP | 1-244089 A | 9/1989 |
| JP | 8-86149 | 4/1996 |
| WO | WO 88/08170 A1 | 10/1988 |
| WO | WO 00/65528 | 11/2000 |
| WO | WO 2005/015114 | 2/2005 |

* cited by examiner

HOLSTER FOR SMALL ARMS

CROSS-REFERENCE TO RELATED APPLICATIONS

This is a National Stage application under 35 USC 371 of PCT/AT2006/000200, filed May 15, 2006, and based on Austrian Patent Application No. A 820/2005, filed May 13, 2005.

FIELD OF THE INVENTION

The invention relates to a holster for small-arms, and more particularly to a holster with a pistol retention facility.

BACKGROUND AND SUMMARY OF THE INVENTION

U.S. Pat. No. 5,127,566 discloses holsters where a folding guard over the end of the weapon prevents the weapon from being removed and from falling out. This guard is locked in the closed position and has a slide bolt fitted on the inside, i.e. on the body side, for release. In addition, the weapon is also retained on the ejection port or window in the holster and must be correspondingly tilted away or twisted in the holster in order to draw the weapon. The guard safety device can be opened by an attacker. Since the mechanism is of course locked and does not give way, the mechanism may be damaged in a fight, which would render it impossible to draw the weapon later. The additional safety device in the ejection window of the weapon necessitates tilting the weapon. If the bearer of the weapon wants to draw the weapon out of fear of being killed, several movements in opposite directions are required—which has been demonstrated to be difficult in stressful situations. If during further actions, when the weapon has already been drawn, the guard safety device snaps shut because of course it is only kept in the open position by friction, holstering the weapon is not possible without releasing the safety guard again, which is extremely difficult because the weapon carrier must hold the weapon and not let the attacker out of his sight.

The holster according to U.S. Pat. No. 6,616,020 provides for a safety bolt which engages in the trigger guard and which is also released by an inner slide.

A holster with 2 safety devices is described in US 2004/0050887 A1 and provides, among other things, for a safety guard as a second safety device over the end of the weapon, which guard is retained in the closed position by spring resilience and which is opened by the locking mechanism of the primary safety device when the mechanism is caused to release, i.e. the safety devices cannot be operated independently of each other.

DE 103 30 676 B3 discloses a holster in which a safety element interacting with a protective trigger guard and a safety guard that overlaps the weapon and can be folded away are provided. Both the safety element and the safety guard are operated by a single operating lever, but in different directions due to movements of this operating lever. Nevertheless, in a scuffle an attacker may actuate the operating lever so that the weapon is fully released and may drop or be pulled from the holster. Also, the safety guard is connected to the operating lever in such a manner that it makes it difficult for the wearer of the holster to draw the weapon if, for tactical reasons or in the course of a scuffle, he faces the attacker on the body side where the holster is hanging. Finally, the movement required by the weapon bearer to open the safety guard involves extending the thumb, which movement opposes the movement for gripping the weapon. Disadvantageously, opposing movements in situations of great stress are very difficult.

The present invention overcomes the limitations of the prior art by providing a holster for small-arms, with two safety devices on the holster body, wherein a primary safety device can be released by an actuating element and the secondary safety device is formed by a guard above the upper end of the holster body, which guard can be folded away to the front independently of the primary safety device.

The object of this invention is to provide a holster that enables the user to release the safety catch easily and quickly and draw the weapon even in the most difficult stress situations, yet which effectively prevents an attacker from snatching the weapon out of the holster of the weapon bearer.

To achieve this object the holster has a guard that can be released by a second actuating element independent of the actuating element of the primary safety device. This allows actuation to release the weapon, by a means that does not require direct contact with the guard.

The retaining force acting on the guard is advantageously less than the force required for folding it away to a releasing condition and which can be exerted directly on the guard. The guard, which is additionally provided for the primary safety device, can be folded away to the front by its actuating element, even without release, due to the force acting in the opening direction. However, this does not release the weapon because it is still retained by the primary safety device. Nonetheless, it gives the weapon bearer enough time to react adequately. If the weapon bearer wants to deactivate the secondary safety device, i.e. the folding guard, he may do so by folding the guard away to the front, to improve readiness in the face of a likely attack.

According to a further feature of the invention, provision is made for an elastic element to act upon the guard in the folding away direction (to a released condition) with a selected force. This force of the elastic element is less than the retaining force. Independent opening of the secondary safety device, the guard, is therefore possible in that the safety guard is simply folded away to the front or automatically folds away to the front by actuation of the actuating element to release it from the secure or closed position. The elastic element, preferably a tension spring, also ensures that the safety guard folds away completely.

If, during a fight, an attacker tears the safety guard visible to him in the forward direction, the guard will simply fold away and the mechanism is undamaged. However, the weapon will continue to be safely retained by the primary safety device, which is not visible to the attacker and cannot be actuated by him. The tension spring that retains the safety guard in the open position also ensures that reholstering is possible without altering the grip on the weapon or diverting attention from the attacker. Even if the safety guard were to be accidentally closed in the course of a fight, this does not present a problem because when the weapon is reholstered the guard can be pushed forward with the barrel or forward end of the weapon. Once the guard is thus dislodged from the detent, the tension spring then automatically folds the guard fully to the open position.

Provision is preferably made for both actuating elements to be arranged immediately adjacent to one another. Therefore both actuating elements can be reached in one stroke with a single finger (typically, the thumb) of the hand. Both safety mechanisms of the weapon can thus be released. It is particularly advantageous for the actuating elements to be arranged on both sides of the thumb of the weapon bearer when the hand grips the weapon for drawing.

Even if the primary safety device is engaged and the secondary safety device is closed, it is then possible for the weapon bearer to release and draw the weapon in one natural movement, without any opposing movement and without tilting, canting or rotating the weapon. Even if the bearer's acuity and dexterity were diminished due to extreme stress, the weapon bearer need only concentrate his mind on gripping the handle of his weapon. From this natural movement he will first open the secondary safety device and then the primary safety device, which devices are advantageously arranged adjacent to one another in this direction of movement. The bearer will then be able to draw his weapon in a straight movement.

However, in order to prevent an attacker from similarly opening both safety devices, the direction of actuation of both actuating elements is advantageously different at least along part of their path, and preferably essentially opposed.

The function of the secondary safety device may be realized by simple structural means when, according to a further feature of the invention, the guard is pivotally installed on two opposite sides of the holster body, an end portion of the guard being of circular design, at least in the shape of a segment, on the inside.

According to an advantageous embodiment of the invention, the circular end portion of the guard is provided with a detent feature. The detent feature includes a recess engaged by a spring loaded detent element. The detent element is essentially displaceable radially to the pivot axis of the guard. The second actuating element is connected to the detent element, so that pressing the actuating element releases the guard to fly open under spring tension. The retaining function is therefore easily realizable for the guard, but this does not represent a locking action and allows the guard to be folded away when force is exerted on it. The retention force is preferably just sufficient for retaining the guard in the closed position against the force of any elastic element, for forced folding away of the guard.

In order to guarantee safe retaining action, provision may be made for an elastic element to act upon the displace-able element with a force in the direction of the pivot axis of the guard.

According to a further feature of an advantageous exemplary embodiment provision is made for the elastic element to follow the circumference of the circular end of the guard over at least part of its length.

In order to be able to draw the weapon even if the secondary safety device is temporarily not possible or is forgotten, a further advantageous embodiment of the invention is characterized in that the secondary safety device can be released by the actuating element of the primary safety device. If for some reason the wearer of the holster has forgotten to actuate the secondary safety device in time, this may still be possible immediately on drawing the weapon by fully depressing the primary safety device, possibly even further than would be necessary to release the primary safety device.

This may be achieved in a structurally simple, and therefore functionally safe manner by ensuring that the actuating element of the primary safety device first releases the primary safety device along its working path, then interacts with the secondary safety device during further displacement.

Provision is made preferably for the actuating element of the primary safety device to move the displaceable element away from the pivot axis of the guard during its further displacement, which displaceable element engages in the recess of the inner end of the guard.

The invention will be explained in further detail in the following description with reference to an exemplary embodiment shown in the attached drawing figures.

DETAILED DESCRIPTION OF A PREFERRED EMBODIMENT

Figure 1:
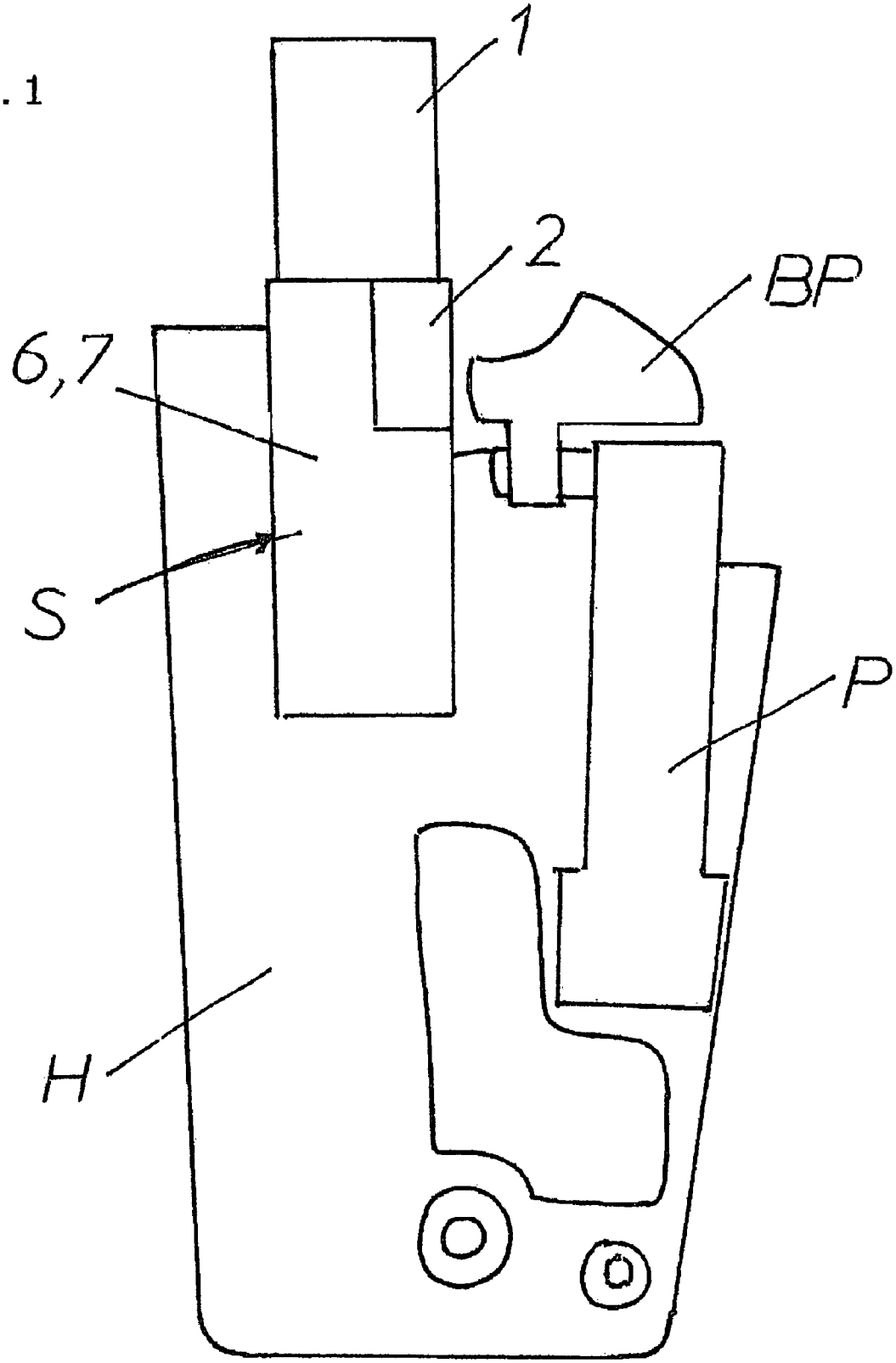
FIG. 1 is a side view of a holster according to a preferred embodiment of the invention, with the side facing the wearer's body shown.

FIG. 1 shows a holster for small-arms with two safety devices P, S on holster body H, wherein a primary safety device P can be released by an actuating element BP. This primary safety device P may incorporate a safety bolt which engages in the trigger guard of the weapon and which is released by a slide, also mounted internally, as actuating element BP.

Secondary safety device S, also provided, may be integrated structurally in holster H, or may also be a separate unit which can in principle also be retrofitted subsequently to any suitable holster. An inserted holster, with two independent safety devices P and S, is therefore provided in interaction with a primary safety device P already provided on the holster.

The secondary safety device S includes safety guard 1, guard lever 2, (represented only schematically in FIG. 1), tension spring 3, compression spring 4 and a rotation brake 5. These components are accommodated in a housing 6 with housing cover 7.

Figure 3:
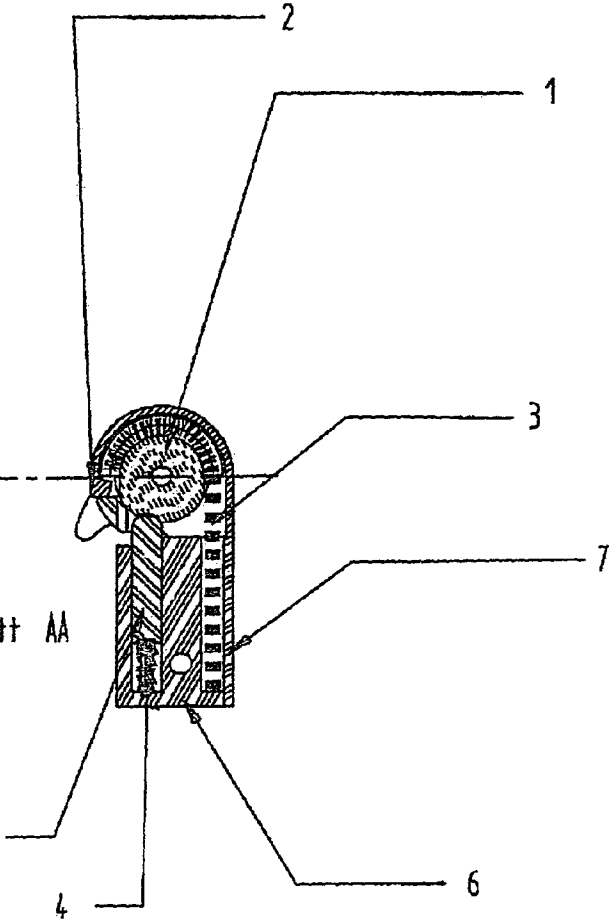
FIG. 3 shows a longitudinal section taken along line A-A in FIG. 2 through the actuating unit of the secondary safety device.
Figure 2:
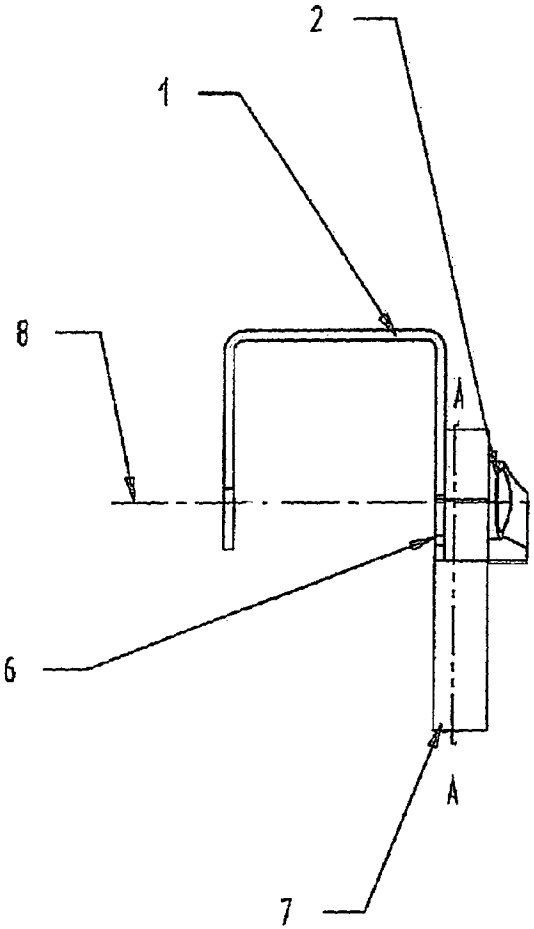
FIG. 2 shows a front view of a secondary safety device according to a preferred embodiment of the invention.
Figure 4:
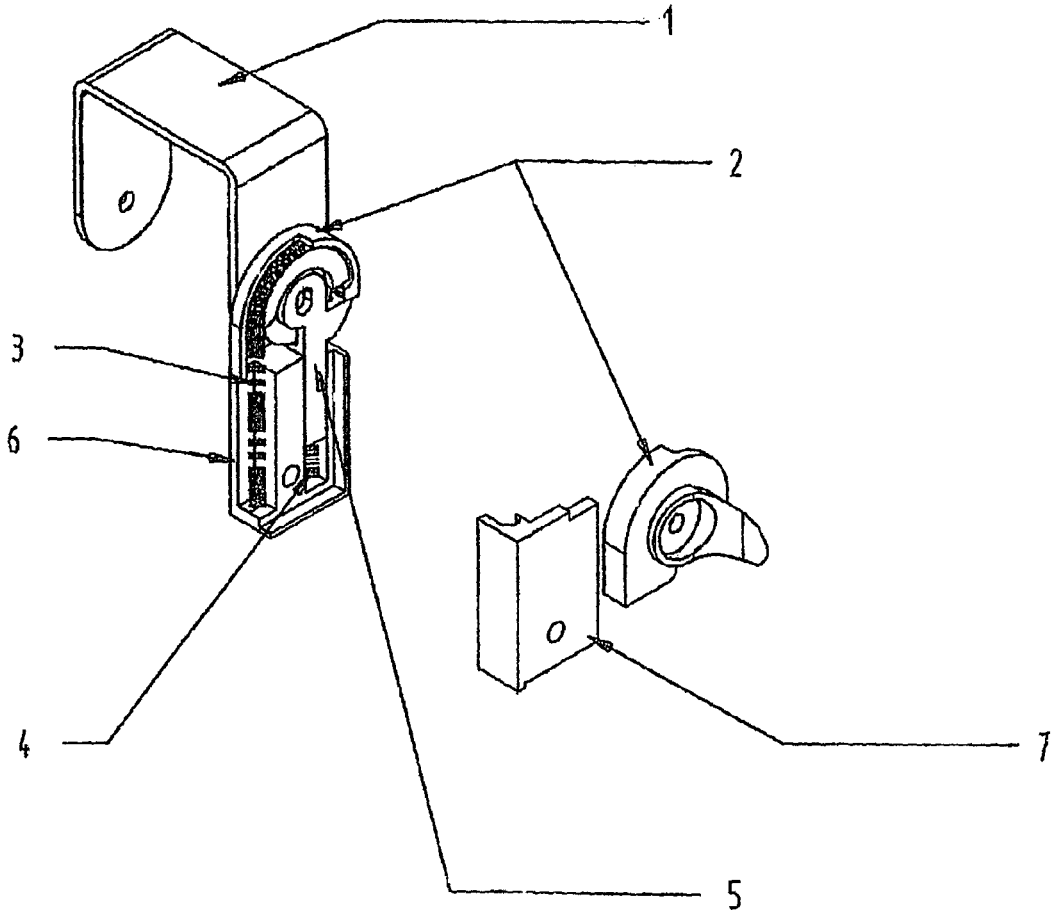
FIG. 4 shows a perspective exploded representation of the secondary safety device in FIGS. 2 and 3.

As can also be seen in FIGS. 2-4, which show a secondary safety device, safety guard 1 is fastened to both sides of the holster body, preferably by means of screws. Thus, it is able to pivot about its axis of rotation 8. The screw points towards the body of the weapon carrier, and also serves as a pivot shaft for guard lever 2, and for the actuating element of the secondary safety device, as well as for securing the housing 6 and the rotation brake or detent pin 5.

On the side facing the user's body, the end of safety guard 1 is designed as a wheel on the circumference of which tension spring 3 is fastened. The other end of tension spring 3 is secured in the housing 6 and would automatically fold away safety guard 1 approximately 90 degrees to the front (to an open or released position), if it were not prevented from doing so by rotation brake 5.

The rotation brake 5 is pressed by a compression spring 4 against the circumference of the wheel of safety guard 1, and interacts with a recess on the end of safety guard 1, designed in the shape of a wheel, in the secure position securing the weapon, as shown in FIG. 1. Compression spring 4 is supported in housing 6. Rotation brake 5 is designed in a preferably semi-circular shape at the point where it presses against the wheel of safety guard 1, and presses into the recess in the wheel of safety guard 1. It is important that no barrier is created to forceful manual movement of the guard (as might occur in a struggle) which folds readily with breaking. Thus an attacker can not disable the safety guard 1 which is visible to an attacker. The guard is able to fold away to the front. The same applies if the weapon carrier wants to holster the weapon and safety guard 1 prevents this, for whatever reason, because it is in the closed position—here it must be possible to fold away the safety guard to the front with the barrel or top of the end of the weapon.

If the weapon bearer wants to open this "secondary safety device", he can either simply fold away safety guard 1 manually by applying force to the guard itself, or he may cause safety guard 1 to be automatically folded away to the front (from the secured position to the released position) by pressing on the guard lever 2. This is preferably done with the thumb of the firing hand, independently of the actuation of actuating element BP of the primary safety device by tension spring 3. This is provided when the guard lever 2 presses upon the rotation brake 5 in such a manner that rotation brake 5 releases safety guard 1 against the force of compression spring 4 so that tension spring 3 causes the guard to fold away to the front. Tension spring 3 retains safety guard 1 in the forward folded open position, and also prevents safety guard 1 from unintentionally folding back to the secured position to block the holster opening.

As can be seen in FIG. 1 in particular, actuating element BP and guard lever 2 are arranged immediately adjacent to each other, preferably approximately one finger width apart. Here it is particularly advantageous for actuating elements 2 BP to be arranged on both sides of the thumb of the weapon bearer. For example, when the hand grips the weapon in holster H for drawing. Both actuating elements BP, 2, can then be reached, for example, with one and the same finger (thumb) of the hand and both safety mechanisms of the weapon can be released in one stroke when the weapon is gripped.

After the weapon is holstered and any primary safety device P present is activated, the secondary safety device must be closed by hand. However, this may take place at any time after the critical situation has been resolved (e.g., attacker in handcuffs), since primary safety device P already retains the weapon in the holster, and protects it from being lost and snatched away from the wearer.

Figure 5:
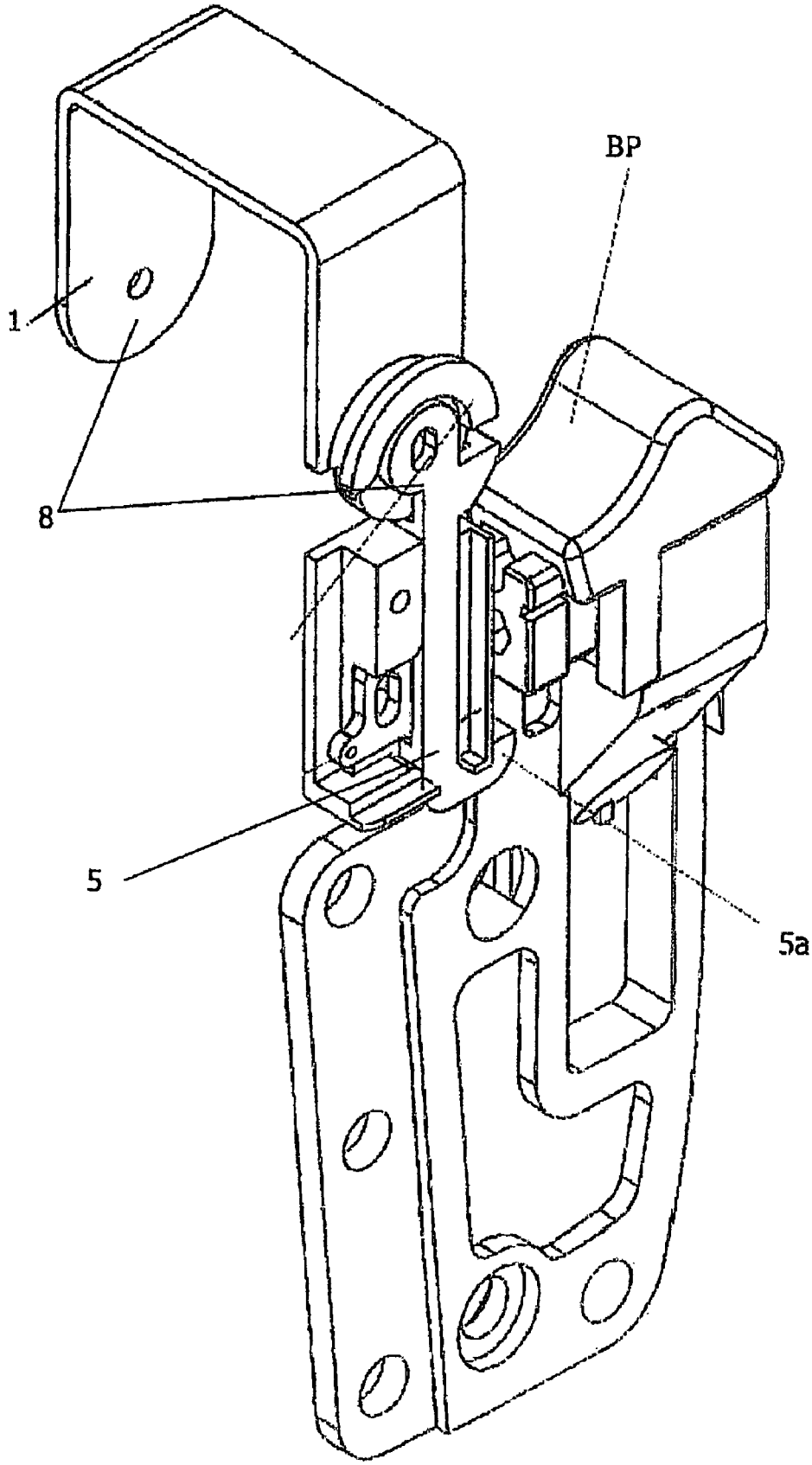
FIG. 5 shows a holster according to an alternative embodiment of the invention with a closed secondary safety device, which can also be released by the actuating element of the primary safety device.

A further embodiment is shown in FIG. 5 with the cover and actuating element 2 of secondary safety device S portion omitted. The rotation brake 5, which can normally be displaced by guard lever 2, as the actuating element of the secondary safety device, against the force of compression spring 4, is provided with a shoulder or hook 5*a* at the end opposite the axis of pivot of safety guard 1. This hook 5*a* now projects in the direction of actuating element BP of primary safety device P, preferably at a point in hits path of displacement at which primary safety device P has already been released. Thus when actuating element BP of primary safety device P is displaced beyond this point of release of primary safety device P, this actuating element BP acts upon rotation brake 5, via hook 5*a*, and displaces this rotation brake 5 away from pivot axis 8 of safety guard 1.

Figure 6:
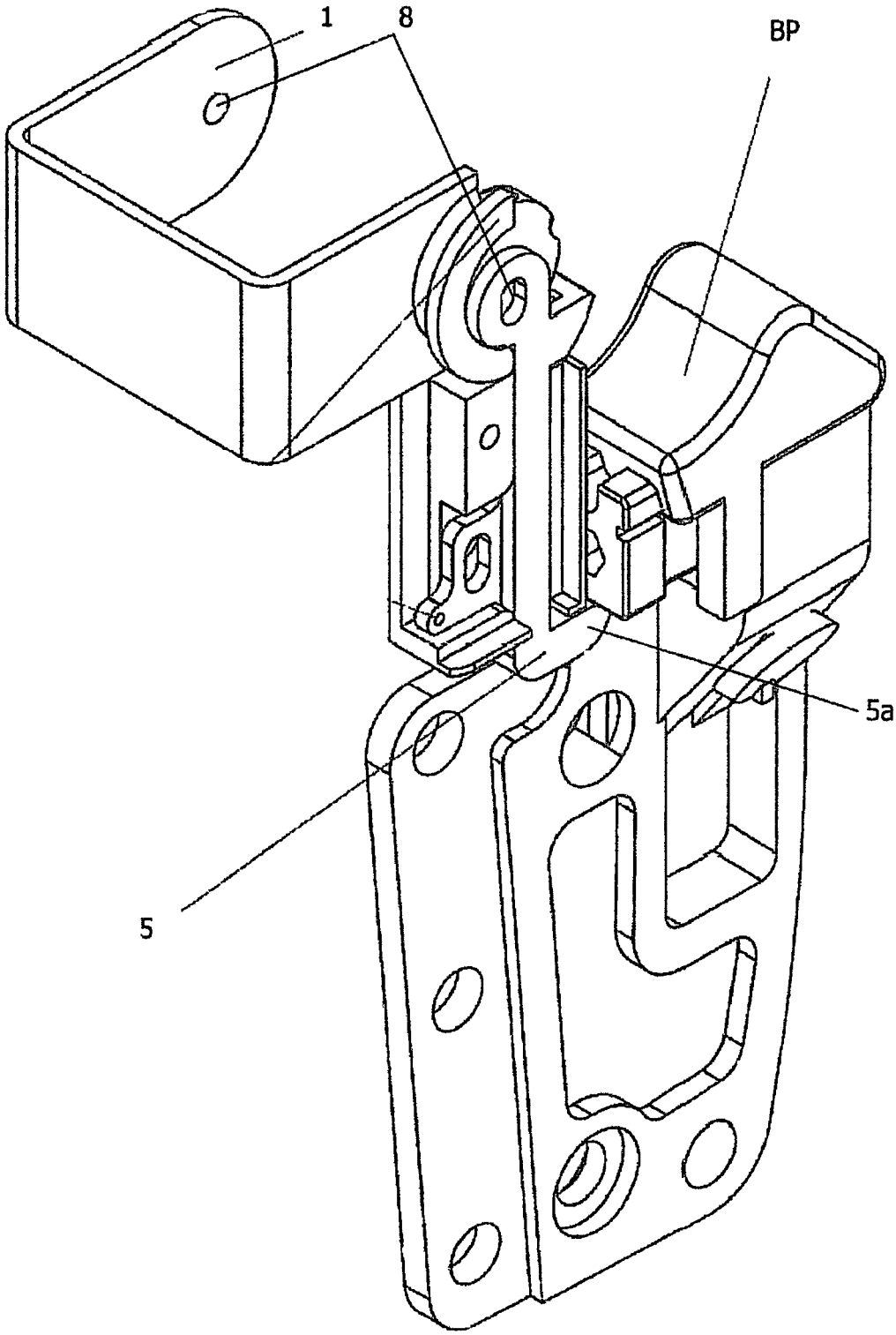
FIG. 6 shows the holster of FIG. 5 with the secondary safety device in a released condition.

The situation shown in FIG. 6 is therefore reached in which, because of the release of rotation brake 5, tension spring 3 (not shown in FIGS. 5 and 6) is able to pivot the safety guard 1 to the front, and can therefore release secondary safety device S. Compression spring 4, acting on rotation brake 5 in the direction of pivot axis 8 of safety guard 8, may also be dispensed with in this embodiment.

While the above is discussed in terms of preferred and alternative embodiments, the invention is not intended to be so limited.

The invention claimed is:

1. A holster for retaining a pistol, the holster comprising:
a bolster body configured to receive a pistol;
a primary safety device on the holster body;
the primary safety device having a secure condition and a release condition;
the primary safety device being operable to prevent extraction of a pistol from the holster when in the secure condition, and to enable extraction of the pistol when in the release condition;
the primary safety device including an actuating element operable in response to deliberate user force to set the primary safety device in the release condition;
a secondary safety device on the holster body;
the secondary safety device having a secure condition and a release condition;
the secondary safety device being operable to prevent extraction of a pistol from the holster when in the secure condition, and to enable extraction of the pistol when in the release condition;
the secondary safety device including a guard lever operable in response to deliberate user force to set the secondary safety device in the release condition;
wherein the secondary safety device is spring-biased to the release condition;
wherein the secondary safety device is retained in the secure condition by a retention force just sufficient to overcome the spring bias to the release condition;
wherein the secondary safety device is operable in response to deliberate user force exerted upon the secondary safety device towards the release condition to set the secondary safety device in the release condition from the secure condition without operation of the guard lever; and
wherein the condition of the secondary safety device and the condition of the primary safety device are independent of one another.

2. The holster of claim 1 wherein the primary safety device engages a trigger guard of the pistol.

3. The holster of claim 1 wherein the secondary safety device includes a safety guard that spans above the holster body when in the secure condition, and extends in front of the holster body in the forward direction to allow pistol extraction when in the release position.

4. The holster of claim 3 wherein the safety guard is pivotally connected to both sides of the holster body by two pivot connections, one on each side of the holster body.

5. The holster of claim 3 wherein the safety guard is spring-biased to the release condition.

6. The holster of claim 5 wherein the secondary safety device includes a brake operable to retain the safety guard in the secure condition.

7. The holster of claim 6 wherein the guard lever is connected to the brake, such that applying force to the guard lever enables a spring to move the safety guard to the release condition.

8. The holster of claim 6 including a detent feature that engages the brake to the safety guard when in the secure condition.

9. The holster of claim 6 wherein the brake is spring-biased to retain the safety guard.

10. The holster of claim 1 wherein the actuating element and guard lever are adjacent to each other.

11. The holster of claim 1 wherein the actuating element and guard lever are positioned a limited width apart, such that they may be operated by one finger in a single stroke.

12. The holster of claim 1 wherein the safety guard is operable in response to deliberate user force exerted in the forward direction to set the secondary safety device in the release condition from the secure condition without operation of the guard lever.

13. A holster for retaining a pistol, the holster comprising:

a holster body configured to receive a pistol;

a safety device on the holster body;

the safety device having a secure condition and a release condition;

the safety device being operable to prevent extraction of a pistol from the holster when in the secure condition, and to enable extraction of the pistol when in the release condition;

the safety device including a guard lever operable in response to deliberate user force to set the safety device in the release condition;

the safety device including a safety guard that spans above the holster body when in the secure condition, and extends in front of the holster body to allow pistol extraction when in the release position;

the safety guard being pivotally connected to both sides of the holster body by two pivot connections, one on each side of the holster body;

the safety guard being spring-biased to the release condition;

the safety guard being retained in the secure condition by a retention force just sufficient to overcome the spring-bias to the release condition; and the safety guard being operable in response to deliberate user force exerted upon the safety guard towards the release condition to set the safety guard in the release condition without operation of the guard lever.

14. The holster of claim 13 wherein the safety device includes a brake operable to retain the safety guard in the secure condition.

15. The holster of claim 14 wherein the guard lever is connected to the brake, such that applying force to the guard lever enables a spring to move the safety guard to the release condition.

16. The holster of claim 14 including a detent feature that engages the brake to the safety guard when in the secure condition.

17. The holster of claim 14 wherein the brake is spring biased to retain the safety guard.

18. The holster of claim 14 wherein the safety guard is operable in response to deliberate user force to set the safety device in the release condition from the secure condition without operation of the guard lever.

* * * * *